US006685288B1

(12) United States Patent
MacMillan

(10) Patent No.: US 6,685,288 B1
(45) Date of Patent: Feb. 3, 2004

(54) DRAWER SLIDE WITH SEQUENCE CONTROL MECHANISM

(75) Inventor: Geoffrey MacMillan, Kitchener (CA)

(73) Assignee: CompX International Inc., Mauldin, SC (US)

( * ) Notice: Subject to any disclaimer, the term of this patent is extended or adjusted under 35 U.S.C. 154(b) by 0 days.

(21) Appl. No.: 09/977,625

(22) Filed: Oct. 15, 2001

Related U.S. Application Data

(60) Provisional application No. 60/240,670, filed on Oct. 16, 2000.

(51) Int. Cl.[7] ..... A47B 88/04

(52) U.S. Cl. ..... 312/334.46; 312/334.44

(58) Field of Search ..... 312/330.1, 333, 312/334.1, 334.7, 334.8, 334.11, 334.17, 334.44, 334.46, 334.47, 350; 384/18, 20, 21

(56) References Cited

U.S. PATENT DOCUMENTS

| | | | | | |
|---|---|---|---|---|---|
| 4,537,450 | A | * | 8/1985 | Baxter | 384/18 |
| 4,560,212 | A | * | 12/1985 | Papp et al. | 312/334.47 X |
| 5,169,238 | A | | 12/1992 | Schenk | |
| 5,466,060 | A | | 11/1995 | Hoffman | |
| 5,671,988 | A | | 9/1997 | O'Neill | |
| 5,695,265 | A | | 12/1997 | Hoffman | |
| 5,757,109 | A | | 5/1998 | Parvin | |
| 5,851,059 | A | | 12/1998 | Cirocco | |
| 5,868,479 | A | | 2/1999 | Hoffman | |
| 5,951,132 | A | * | 9/1999 | Cirocco | 312/334.46 |
| 6,033,047 | A | | 3/2000 | Hoffman | |
| 6,155,661 | A | | 12/2000 | O'Neil et al. | |
| 6,238,031 | B1 | * | 5/2001 | Weng | 312/334.46 X |
| 6,244,678 | B1 | * | 6/2001 | Dopp et al. | 312/334.44 X |

FOREIGN PATENT DOCUMENTS

| | | | | |
|---|---|---|---|---|
| CA | 2044203 | | 3/1997 | |
| FR | 1174453 | * | 3/1959 | 312/334.47 |

* cited by examiner

*Primary Examiner*—James O. Hansen
(74) *Attorney, Agent, or Firm*—Banner & Witcoff, Ltd.

(57) ABSTRACT

A drawer slide assembly has at least three telescoping slide channels, including an outer channel, an intermediate channel and an inner channel. A mechanism is provided to control the sequential movement of the channels between the open and closed positions including a retention lock between the two inner most channels which is released upon sliding movement of those channels together toward the open position and engagement of a lever mounted on the intermediate channel with a raceway of the outer channel to thereby release the inner channel.

5 Claims, 3 Drawing Sheets

DRAWER SLIDE WITH SEQUENCE CONTROL MECHANISM

CROSS REFERENCE TO RELATED APPLICATION

This is a utility application based upon previously filed provisional application Serial No. 60/240,670 filed Oct. 16, 2000 for a Drawer Slide With Sequence Control Mechanism which is incorporated herewith by reference and for which priority is claimed.

BACKGROUND OF THE INVENTION

In a principal aspect, the present invention relates to the improvement in a three-part drawer slide of a mechanism for controlling the sequence of operation of the separate slide members or channels comprising the slide.

Drawers mounted on slides in filing cabinets often are comprised of multiple, telescoping slide channels. Typically, three or more sliding channels are utilized on each side of a drawer. One of the channels is connected to the wall of the drawer cabinet. A second or intermediate channel slides within the first channel. A third channel is connected to the side of the drawer. Withdrawal of the drawer from the cabinet to open the drawer effects telescoped extension of the second and third channels.

It is often desirable to provide that the channels will move sequentially. That is, typically, the second or intermediate and third channel will move in unison. Thus, if a drawer is partially opened, the second or intermediate channel and third or drawer channel connected to the drawer will first extend or telescope together as a unit fully from the channel connected to the cabinet wall. Thereafter, upon further opening of the drawer, the outer channel or third channel will extend from the second or intermediate channel.

Providing a mechanism to ensure sequential operation of the second and third drawer slide channels is thus a desirable objective.

SUMMARY OF THE INVENTION

Briefly, the present invention comprises an improvement in drawer slides having three or more channels. The improvement relates to the mechanism for controlling the sequential operation of the drawer slide channels or elements. In particular, in a construction having a first channel, an intermediate or second channel slidable in the first channel and a third channel slidable in the second or intermediate channel, there is provided a retention mechanism interconnecting the second and third channels. The retention mechanism ensures that the second and third channels move simultaneously as a unit when the assembly of second and third channels is moved from the fully closed toward the open position. Upon reaching the full extension or sliding movement of the second and third channels as a unit in the first or outside channel, a release mechanism disengages the retention mechanism connecting the second and third channels. In a preferred embodiment, the release mechanism comprises a slot or raceway mounted on the first channel that engages a retention pin associated with the second and third channels and releases that retention mechanism. Upon release, the third channel may be telescoped or extended from the second channel thereby permitting the full opening of the drawer.

Thus, it is an object of the invention to provide an improved channel slide construction for drawers having three or more telescoping channels.

It is a further object of the invention to provide a channel slide construction for drawers having three or more channels wherein two of the channels are retained in an interlocked relationship until they telescope in unison in a third channel beyond a fixed distance.

It is a further object of the invention to provide a mechanism for sequential operation of multiple channel members which is economical, rugged, easy to assemble and relatively safe.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
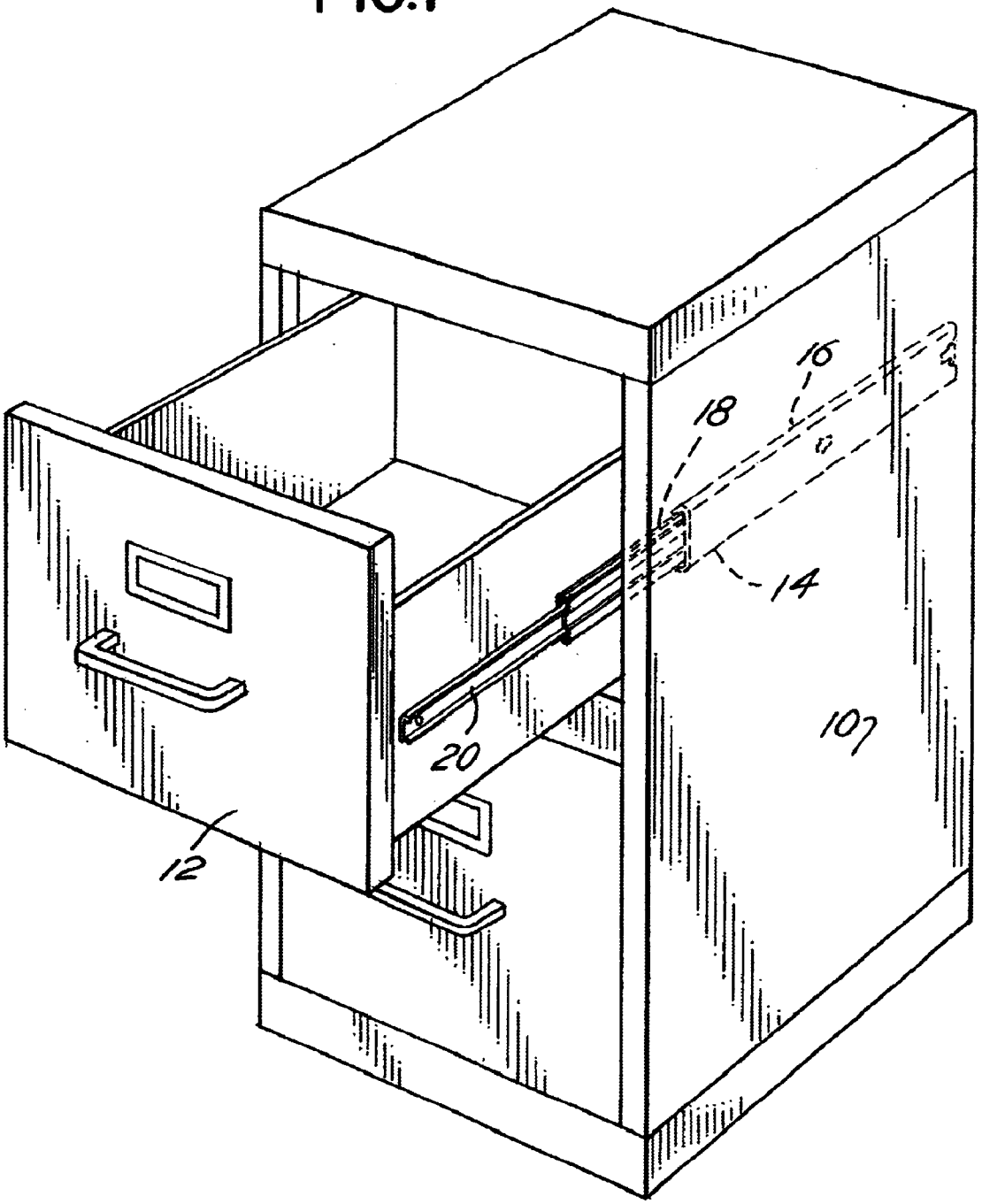
FIG. 1 is an isometric view of a typical drawer and cabinet construction incorporating drawer slides of the type comprising the invention.
Figures 2, 3:
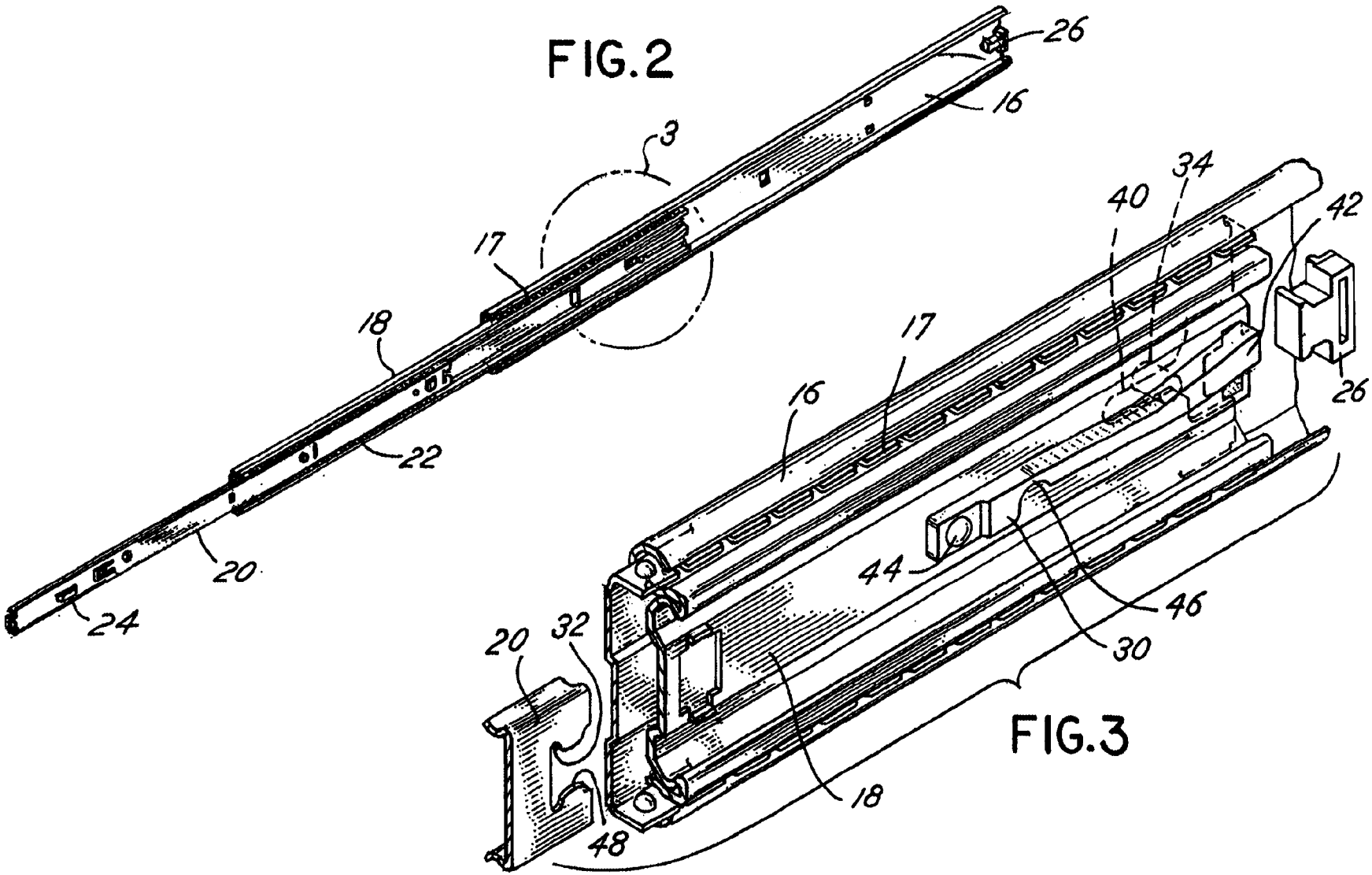
FIG. 2 is an enlarged isometric view of a drawer slide incorporating a sequential control mechanism of the invention.
FIG. 3 is an enlarged isometric view of the control mechanism of FIG. 2.

Referring to the figures, the slide construction of the invention is designed for incorporation in a file cabinet for mounting of drawers in the cabinet. The slide construction typically includes three or more slide channels which telescopically fit one into the other. Referring to FIG. 1, cabinet 10 includes drawers 12 slidably mounted for horizontal movement into and out of the cabinet 10. The drawers 12 are mounted on multiple channel slides, such as a drawer slide 14, comprised of a first or outside channel 16, a second or intermediate channel 18 that is telescopically and slidably mounted in the first channel races, such as bearing races. A third or inner or inside channel 20 is attached to drawer 12 and is telescopically and slidably mounted in the intermediate channel 18 by raceways and bearings. Note that the outside channel 16 is generally U-shaped with a flat side or top side of the U facing against the inner wall of cabinet 10. The intermediate channel 18 is similarly U-shaped and fits within the outside channel 16 being slidably mounted therein on raceways. The third or inside drawer channel 20 is also U-shaped; however, it is inserted or placed within the intermediate channel so that the flat surface or crown of the U-shape is facing inwardly from the cabinet 10 and against the side wall of drawer 12. FIG. 3 and FIG. 2 illustrate the arrangement of the described channels 16, 18, and 20. Thus, channel 16 is attached to the inside wall of cabinet 10. Channel 18 slides on raceways or bearing races 17 intermediate outside channel 16 and intermediate channel 18. Inside channel 20 likewise slides on bearing races or raceways 22 mounted in intermediate channel 18. The inside channel 20 includes tabs, for example, tab 24, for attachment to the side wall of a drawer such as drawer 12.

The subject matter of the invention relates to a mechanism for interlocking or maintaining the third or inside drawer channel 20 and the second or intermediate channel 18 locked or engaged one with the other when a drawer 12 is initially opened. In that manner, the inside channel 20 and intermediate channel 18 will initially move in unison together toward the open position as the drawer 12 is opened. Upon reaching the desired limit of extension of the two channels; namely, inside channel 20 and intermediate channel 18 toward the open position, a mechanism is provided which releases the engagement of the inside channel 20 from the intermediate channel 18 thereby permitting extension of inside channel 20 as the drawer is moved to a fully opened position. As a further feature of the invention in combination, the inside channel 20 engages with a resilient retaining member 26 at the inside end of the outside channel 16 to retain the drawer 12 in a closed position until the holding force associated with the resilient member 26 is overcome by pulling outwardly on the drawer 12 to release channel 20 from member 26.

The mechanism for providing the sequential operation of the channels is comprised of a resilient, elastomeric arm 30 mounted on the intermediate channel 18 so as to engage with a stop surface 32 of the inside channel 20 when the channels 18 and 20 are moved toward the open position. The resilient arm 30 includes a projecting pin actuator or lug 34 that extends into the pathway of a raceway 17 provided between the outside channel 16 and intermediate channel 18. The raceway 17 includes a cam pathway 40 in FIG. 5 and FIG. 3 which engages the projecting pin actuator or lug 42, moves the arm 30 by flexing the arm 30 in a manner which releases the projecting lug 42 of the arm 30 from engagement with surface 32 of inside channel 20 to thereby release the channel 20 as the assembly of the intermediate channel 18 and inside channel 20 move toward the drawer open position.

Figure 7:
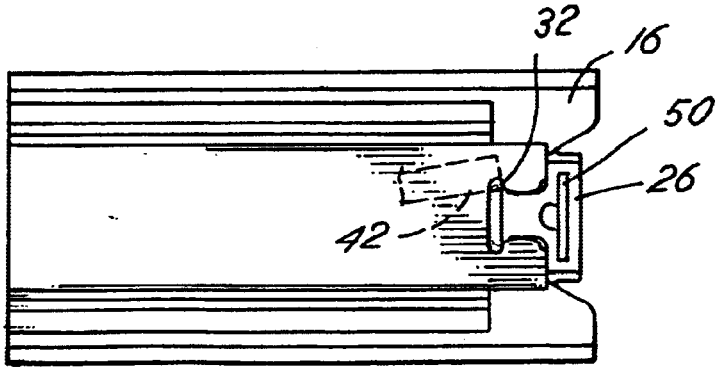
FIG. 7 is an elevation of the three channels wherein they are in the closed position and the inner channel is faced with a resilient retaining lug.

Referring therefore to the figures, intermediate channel 18 includes the flexible arm 30 attached thereto by a rivet or fastener 44. Flexible arm 30 flexes about its length as a cantilever beam. A flex point in the described construction depicted is provided at a narrowed section 46 of the arm 30. The arm 30 projects forwardly and defines a lug 42 which projects into the pathway of the inside channel 20, and more particularly, the lug engaging surface of the channel 20. The channel 20 includes a detent cutout section 48 at its inside end which is designed for cooperation with the elastomeric resilient retaining member or retention bumper 26. Thus, as depicted in FIG. 7 when the channels 16, 18 and 20 are in the closed position, the detent section 48 engages with the bumper 26 which is attached by a metal tab 50 to the outside channel 16 to retain the three channels 16, 18, 20 in the closed position until the drawer 12 is engaged and pulled so as to release the detent 48 from the resilient bumper and retaining member 26.

Figure 5:
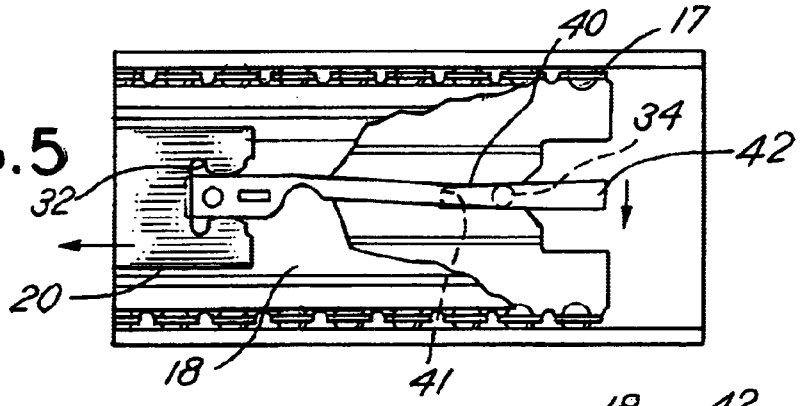
FIG. 5 is an elevation similar to FIG. 4 wherein the inner channel has been moved to a position wherein engagement between the inner channel and the intermediate channel is effected by release of a connecting lever arm.
Figure 4:
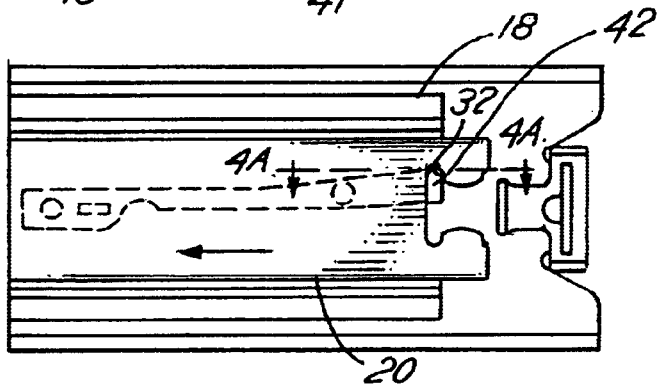
FIG. 4 is a side plan view or elevation of the slide construction depicting the three channels comprising an outer, an intermediate channel and an inner channel wherein the intermediate channel and inner channel are connected so as to move together in unison as a drawer attached to the inner channel is opened by movement in the direction of the arrow.
Figure 4A:
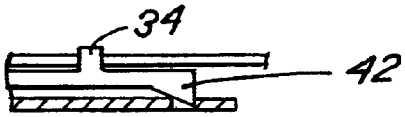
FIG. 4A is a cross sectional view illustrating a resilient lever arm mounted on the intermediate channel and engaged by the inside channel taken along the line 4A—4A in FIG. 4.
Figure 6:
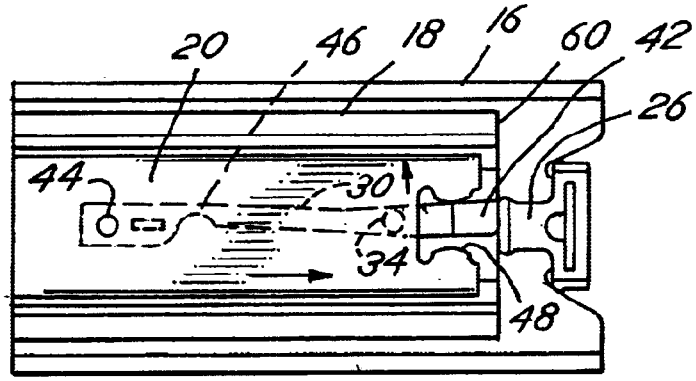
FIG. 6 is an elevation similar to FIG. 4 depicting the operation of the slide as a result of movement of the inner channel toward the closed position after the intermediate channel and inner channel have been disconnected, the drawer fully opened and then subsequently moved to the closed position.

The sequence of operation of the assembly is depicted in FIGS. 4, 5 and 6 in greater detail. Referring to FIG. 4, the inside channel 20 is initially engaged by the intermediate channel 18 and moved in unison therewith as the two channels move to the left as depicted in FIG. 4. Such engagement is effected by virtue of the lug 42 engaging with the retention surface 32 of channel 18. Thus, as the inside channel 20 is moved to the left in FIG. 4, the intermediate channel 18 likewise moves therewith pulled by lug 42 against surface 32.

FIG. 5 illustrates the subsequent sequential operation. Specifically, the lug 42 becomes disengaged from the stop surface 32 inasmuch as the projecting pin 34 is engaged by the raceway cam slot 40 of raceway 17. The projecting pin 34 thus engages and rides into the slot 40. This moves the lug 42 downwardly into the center of the detent slot 48 in the direction of the arrow in FIG. 5 thereby releasing the inside channel 20 from the intermediate channel 18. The inside channel 20 may then be moved to the full open position. The intermediate channel 18 is effectively stopped in its movement by virtue of the engagement of the projecting pin 34 with the end 41 of the raceway slot 40.

FIG. 6 illustrates the operation of the slide as the intermediate channel 18 and inside channel 20 are moved to the closed position. The intermediate channel 18 moves so that the distal inside end 60 of the intermediate channel engages against the stop or bumper 26. Subsequently, the inside channel 20 moves to the right in FIG. 6 so that the detent opening 48 is positioned to engage with the bumper or resilient [[stop]] retaining member 26. The movement of the inside channel 20 to the fully closed position, as shown in FIG. 7, permits the resilient biasing arm 30 to move in the direction of the arrow in FIG. 6. Such movement repositions the lug 42 for engagement with the stop surface 32. That is the arrangement then when the component parts are in the position illustrated by FIG. 7. The lug 42 is in the position shown in FIG. 7 engaging with the stop surface 32.

With the construct of the present invention, it can be seen that a fewer number of parts are required to provide for sequential operation. A single biasing arm 30 having appropriate lugs 42 and pins 34 for cooperation with an existing raceway 17 construction associated with the outside channel 16 enables sequential control of the slide mechanism. Various alternatives and changes may be made without departing from the spirit and scope of the invention. The invention is therefore limited only by the following claims and equivalents thereof.

What is claimed is:

1. In a drawer slide assembly having at least three telescoping channels including an outside channel, an intermediate channel and an inside channel, said channels slidably mounted with the intermediate channel slidable in the outside channel and the inside channel slidably mounted in the intermediate channel, said channels including raceways therebetween to facilitate sliding movement of the channels, the improvement comprising, in combination:

a sequence control mechanism for retaining the intermediate and inside channel movable in unison in the outside channel for a finite distance of travel, said mechanism including a biased lever arm mounted on the intermediate member, said lever arm including a projecting lug, in the path of the inside channel, said inside channel including a detent for receipt of the projecting lug, said raceway between the outside and intermediate channels including a cam slot, said lever arm further including a projecting pin actuator in the pathway of said raceway cam slot between the outside and intermediate channels, said raceway cam slot configured for engaging the projecting pin actuator and effecting cantilever motion of the lever arm to release the lug from the detent.

2. The drawer slide assembly of claim 1 wherein the raceway cam slot extends in the direction of channel travel.

3. The drawer slide assembly of claim 1 wherein the raceway is positioned intermediate the closed and open position of the intermediate channel.

4. The drawer slide assembly of claim 1 wherein the lever arm is a flexible, elastomeric member attached at one end to the intermediate channel.

5. The drawer slide assembly of claim 1 in combination with a detent and stop assembly connecting the inside channel and outside channel when the slide is in the load position.

* * * * *